United States Patent [19]

Cozzi et al.

[11] Patent Number: 5,012,971

[45] Date of Patent: May 7, 1991

[54] FOOD CONTAINER AND METHOD

[75] Inventors: Joseph J. Cozzi, Chicago; Timothy F. Conway, Riverside, both of Ill.; John A. LaFleur, Richmond, Va.; Eileen M. Rusnak, Darien; Neil H. Johnson, Clarendon Hills, both of Ill.

[73] Assignee: Restaurant Technology, Inc., Oak Brook, Ill.

[21] Appl. No.: 573,940

[22] Filed: Aug. 28, 1990

Related U.S. Application Data

[63] Continuation-in-part of Ser. No. 267,898, Nov. 7, 1988, Pat. No. 4,951,866.

[51] Int. Cl.[5] ..... B65D 5/48

[52] U.S. Cl. ..... 229/120.07; 220/4.23; 220/520; 220/521; 220/529; 229/2.5 R; 229/120.32; 229/902; 426/115; 426/120

[58] Field of Search ..... 229/120.06, 120.07, 229/120.32, 2.5 R, 902, 904, 906; 426/115, 119, 120, 128, 129; 220/4.22, 4.23, 520, 521, 522, 529

[56] References Cited

U.S. PATENT DOCUMENTS

| | | | |
|---|---|---|---|
| D. 224,554 | 8/1972 | Swett | D44/1 |
| D. 241,820 | 10/1976 | Jewell | D9/219 |
| D. 241,822 | 10/1976 | Jewell | D9/235 |
| D. 246,560 | 12/1977 | Beauchamp et al. | D7/76 |
| D. 251,657 | 4/1979 | Jewell | D9/219 |
| D. 252,913 | 9/1979 | Barcliff | D9/184 |
| D. 253,456 | 11/1979 | Payne | D9/182 |
| D. 254,776 | 4/1980 | Edwards | D9/183 |
| D. 256,097 | 7/1980 | Amberg | D9/219 |
| D. 258,722 | 3/1981 | Commisso et al. | D9/423 |
| D. 259,543 | 6/1981 | Commisso et al. | D9/426 |
| D. 263,023 | 2/1982 | Commisso | D9/347 |
| D. 263,684 | 4/1982 | Davis | D9/426 |
| D. 263,798 | 4/1982 | Edwards | D9/426 |
| D. 274,889 | 7/1984 | Sullivan . | |
| D. 277,167 | 1/1985 | Dart | D9/347 |
| D. 278,412 | 4/1985 | Yeung | D9/420 |
| D. 285,414 | 9/1986 | Goetz et al. | D9/420 |

(List continued on next page.)

FOREIGN PATENT DOCUMENTS 927789 6/1973 Canada ..... 217/162

(List continued on next page.)

OTHER PUBLICATIONS

Application Ser. No. 027,345 to Cyr.

James River Paper Board Divided Container, design date approximately 1985.

Dopaco Divided Container, design date approximately 1985.

Traex, design date approximately 1985.

International Paper Divided Container, design date approximately 1985.

Sweetheart Divided Container, design date approximately 1985.

James River Foam Divided Container, design date approximately 1985.

*Primary Examiner*—Gary E. Elkins

*Attorney, Agent, or Firm*—Jenner & Block

[57] ABSTRACT

A compartmented container that is especially suitable for containing food is provided. The container or package in one embodiment comprises a first or bottom compartment and a second or top compartment that is hinged to the first compartment. The container further includes a latch mechanism composed of a locking latch extending from one compartment and a locking aperture in the other compartment into which the latch can be inserted when the container is in the closed position. A removable platform forms part of the container and is positionable over the open portion of one of the compartments. The platform includes a support tab dimensioned to allow insertion into the locking aperture when the platform is positioned over the open portion of one of the compartments. An elongated slot extends adjacent the hinge to permit the platform to be removed from the container through the slot. A gripping tab can be provided as part of the platform that extends through the slot when the container is in the closed position to facilitate removal of the platform therefrom.

19 Claims, 3 Drawing Sheets

U.S. PATENT DOCUMENTS

| | | | |
|---|---|---|---|
| 604,388 | 5/1898 | Hamilton . | |
| 678,145 | 7/1901 | White . | |
| 707,062 | 8/1902 | Heineman . | |
| 897,458 | 9/1908 | Dickeson . | |
| 944,145 | 12/1909 | Nemsey . | |
| 981,744 | 1/1911 | Bowditch . | |
| 1,319,024 | 10/1919 | Warfield . | |
| 1,706,334 | 3/1929 | Toch . | |
| 2,008,429 | 7/1935 | Weatherhead, Jr. . | |
| 2,114,530 | 4/1938 | Gorton, Jr. | 99/174 |
| 2,457,043 | 12/1948 | Histand . | |
| 2,510,211 | 6/1950 | Cleary | 229/15 |
| 2,575,192 | 11/1951 | Shepard | 229/2.5 R |
| 2,631,939 | 3/1953 | Peters | 99/171 |
| 2,739,751 | 3/1956 | Bailey | 220/522 |
| 2,783,874 | 3/1957 | Brown et al. | 220/522 |
| 2,852,177 | 9/1958 | Frasch | 229/15 |
| 3,292,810 | 12/1966 | Schechter | 220/4 |
| 3,310,905 | 3/1967 | Davis et al. . | |
| 3,351,265 | 11/1967 | Miller | 229/43 |
| 3,360,115 | 12/1967 | Joffe . | |
| 3,360,153 | 12/1967 | Wheaton, Jr. . | |
| 3,381,873 | 5/1968 | Hirota | 229/2.5 |
| 3,394,869 | 7/1968 | Fontana et al. | 229/51 |
| 3,567,013 | 3/1971 | Tannenbaum | 206/42 |
| 3,730,418 | 5/1973 | Spencer | 229/27 R |
| 3,746,241 | 7/1973 | Seymour | 229/15 |
| 3,829,003 | 8/1974 | Dilot | 229/31 R |
| 3,858,717 | 1/1975 | Peters | 206/44.12 |
| 3,933,296 | 1/1976 | Ruskin et al. . | |
| 3,961,708 | 6/1976 | von Dohlen et al. . | |
| 3,999,661 | 12/1976 | Jones . | |
| 4,079,880 | 3/1978 | Edwards | 229/45 R |
| 4,081,077 | 3/1978 | Franck | 206/219 |
| 4,094,454 | 6/1978 | Snyder | 229/15 |
| 4,132,344 | 1/1979 | Jewell | 229/2.5 R |
| 4,137,333 | 1/1979 | Daswick | 426/120 |
| 4,143,165 | 3/1979 | Daswick | 426/113 |
| 4,226,358 | 10/1980 | Ottow | 229/44 |
| 4,234,097 | 11/1980 | Daenen | 220/4 D |
| 4,241,863 | 12/1980 | Faller . | |
| 4,265,216 | 5/1981 | Marshall et al. | 126/263 |
| 4,335,842 | 6/1982 | Bradford et al. | 229/15 |
| 4,465,190 | 8/1984 | Cillario | 206/526 |
| 4,585,124 | 4/1986 | Pride | 206/559 |
| 4,653,685 | 3/1987 | Leary et al. | 229/2.5 R |
| 4,708,248 | 11/1987 | Davis | 206/549 |
| 4,844,330 | 7/1989 | Roosa et al. . | |
| 4,951,866 | 8/1990 | Rusnak | 229/120.32 |

FOREIGN PATENT DOCUMENTS

| | | | |
|---|---|---|---|
| 959458 | 12/1974 | Canada | 217/179 |
| D40599 | 4/1976 | Canada . | |
| 1061264 | 8/1979 | Canada | 190/26 |
| 1075646 | 4/1980 | Canada | 217/12 |
| 1100424 | 5/1981 | Canada | 190/35 |
| 1232579 | 2/1988 | Canada | 217/12 |
| 1242675 | 10/1988 | Canada | 217/162 |
| 825459 | 12/1951 | Fed. Rep. of Germany . | |
| 1225103 | 9/1966 | Fed. Rep. of Germany . | |

Fig. 5
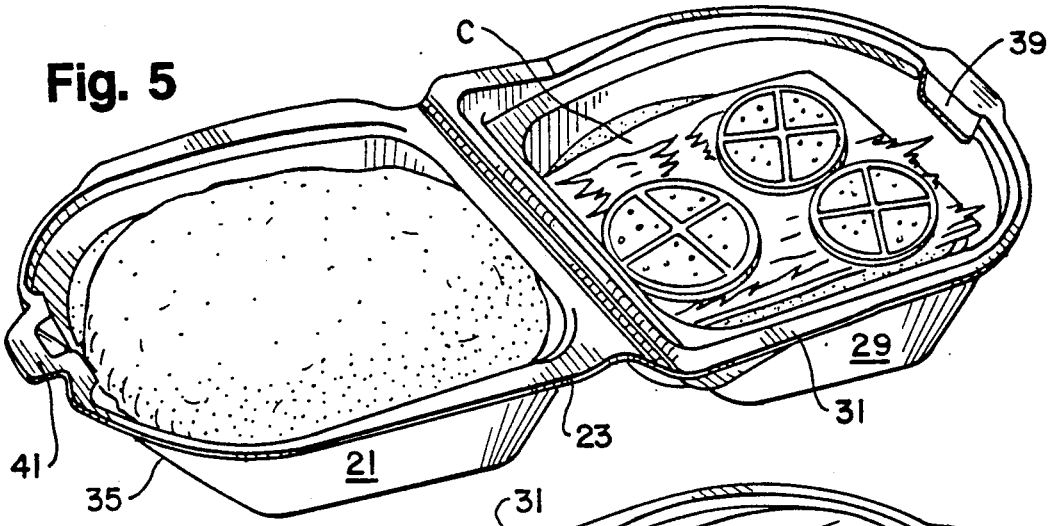
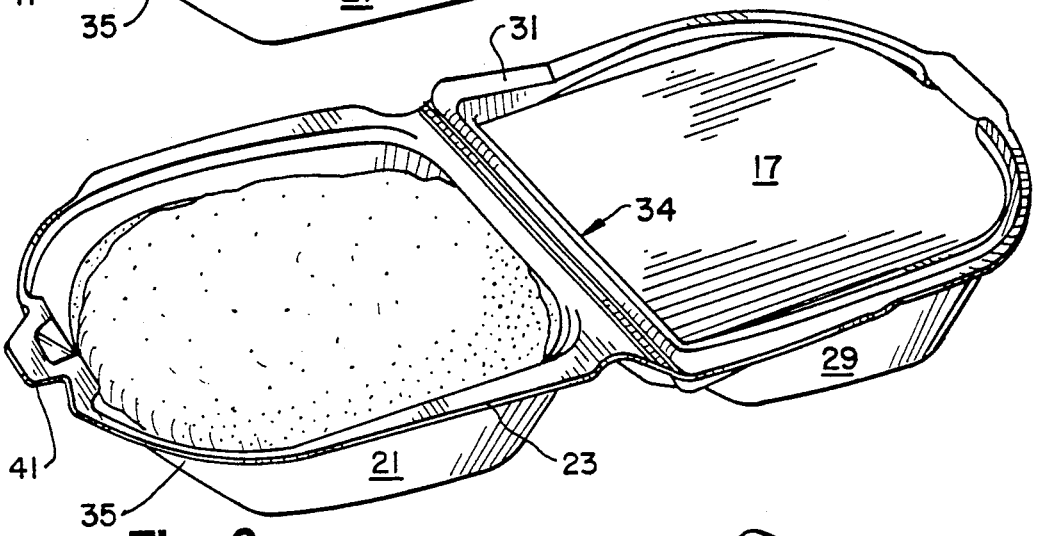
Fig. 6
Fig. 7
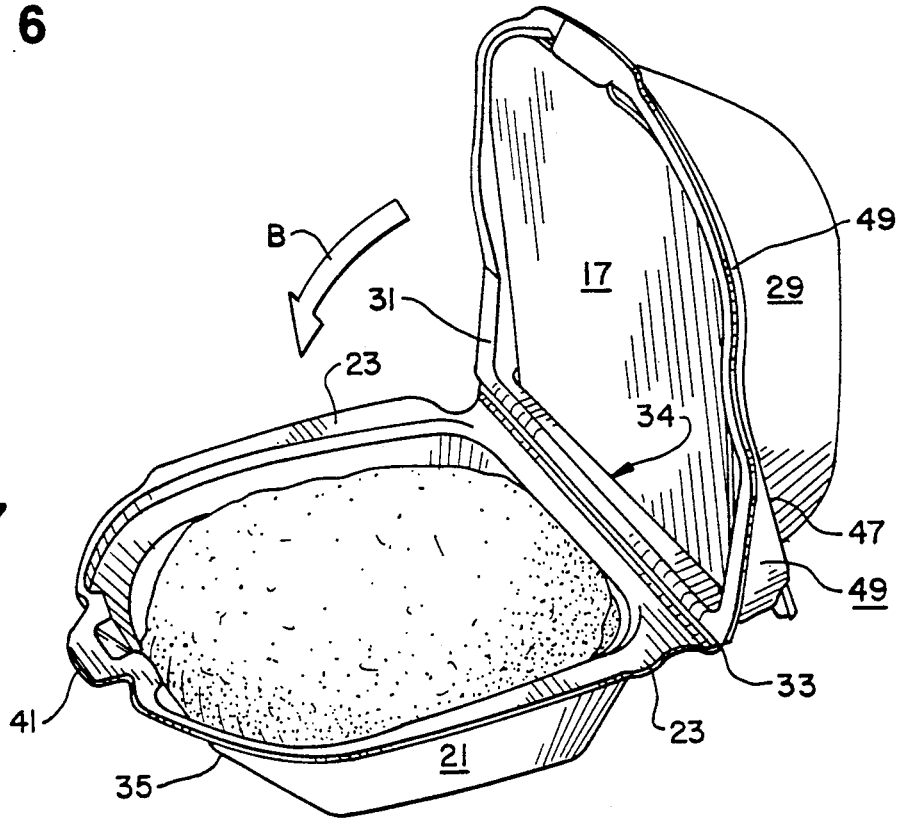

FOOD CONTAINER AND METHOD

RELATED APPLICATIONS

This application is a continuation-in-part application of U.S. Ser. No. 07/267,898, filed Nov. 7, 1988 now U.S. Pat. No. 4,951,866 issued Aug. 28, 1990, the entire disclosure of which is incorporated by reference.

FIELD OF INVENTION

This invention relates to a container. More particularly, in one embodiment, the invention relates to a food container having two compartments that are especially adapted for separately containing the contents of the two compartments.

BACKGROUND OF THE INVENTION

For containing certain materials, including various types of foods and especially foods that are served at quick service restaurants, it would be desirable to have a segregated container or package to keep portions of the contained material separate. It would be especially desirable to have such a container for food, such as a hamburger sandwich, in which the relatively hot (or moist) portion of the sandwich is segregated from the relatively cool (or dry) portion of the sandwich, where the sandwich can easily be loaded and enclosed in the container.

In addition, a need exists for such a container or package that is easy and simple to utilize, which contains the packaged material or food without deformation of the contents and where the contents can be assembled easily by the consumer.

SUMMARY OF THE INVENTION

In accordance with the present invention, a container or package that is especially suitable for containing food is provided. In accordance with one embodiment, the container or package comprises a first or bottom compartment defined by a bottom portion and side portions with an open portion opposite the bottom portion. A second or top compartment is provided that is defined by a bottom portion and side portions and an open portion opposite the bottom portion. The first and second compartments are hinged together by a suitable hinge structure permitting the second compartment to be folded over and onto the first compartment to define an enclosed volume composed of the first and second compartments with the bottom portion of the second compartment defining the top of the container when the container is in a closed position.

A latch mechanism for locking the container together in the closed position is provided and includes a locking latch extending from the side opposite from the side where the hinge structure is located in one of the compartments and a locking aperture in the side opposite from where the side the hinge structure is located, in the other of the compartments. The locking latch and the locking aperture are located to permit insertion of the locking latch into the locking aperture when the container is in the closed position.

A removable platform is positionable over the open portion of one of the compartments. The platform has a periphery, a portion of which defines a support tab projecting from the platform. The support tab is dimensioned to allow insertion of the tab into the locking aperture when the platform is positioned over the open portion of one of the compartments to restrain movement of the platform.

The elongated slot extending adjacent the hinge structure is provided in the side of one of the compartments through which the platform can be removed from the container while the container is in the closed position.

The platform may further include a gripping tab opposite from the support tab. When the platform is placed in position in the container, the gripping tab extends through the elongated slot for facilitating removal of the platform from the container when the container is in the closed position and also for supporting the platform in conjunction with the support tab.

The elongated slot and locking aperture are preferably located so that when the container is in the normal upright, closed position and the platform is in position in the container with the elongated tab extending through the elongated slot in the support tab being in the locking aperture, the platform is inclined upwardly from the locking aperture to the elongated slot. This facilitates combining the contents of the first and second compartments by removing the platform through the elongated slot.

In accordance with one embodiment of the container of the present invention, the elongated slot and the latching aperture are located in the second or top compartment and the locking latch is located in the bottom or first compartment.

In accordance with still another aspect of the invention, the container is a "clamshell" type container in which each compartment is composed of four side portions including two spaced apart sidewalls, a front wall and a rear wall. The top or second compartment may have a depth that is defined by the four side portions that increases from the rear wall to the front wall, with the elongated slot being disposed in the rear wall. Similarly, the first compartment can have a depth that decreases from its rear wall to its front wall. Preferably, the decrease in the height of the bottom portion of the container extending from back to front is equal to the increase in the height of the top or second compartment from back to front so that the top and bottom of the container are generally parallel to each other when the container is in the closed position.

In accordance with still another embodiment of the present invention, the inclination of the platform substantially corresponds to the increase in the depth of the second or top compartment from the rear wall to the front wall.

In accordance with still another embodiment of the present invention, the side of the compartment through which the elongated slot extends includes a strengthened portion adjacent the elongated slot. The strengthened portion may comprise a shoulder extending substantially along the entire length of the elongated slot.

Removal of the platform or insert is accomplished by grasping the portion of the platform that extends through the elongated slot and pulling the insert from the container through the elongated slot while the container is closed. The contents of the top and bottom compartments are thereby combined without further handling by the consumer. The second compartment includes a slot in one of its side portions adjacent the open portion of the second compartment.

The package may further comprise a gripping tab on the periphery of the platform, opposite the support tab, that extends beyond at least one of the side portions of the package when the platform is in position in the slot and over the opening of the second compartment, for facilitating removal of the platform from the package when the package is closed. The gripping tab also facilitates support of the platform in conjunction with the support tab and transfers at least a portion of the weight of the platform and any contents in the compartment to the side portions of the package.

The support tab, in conjunction with the gripping tab, can serve to prevent the platform from sagging or moving into the first compartment when the package is closed, thereby preventing contact and deformation of any contents contained in the first compartment.

In accordance with still another aspect of the present invention, a method of packaging a sandwich that includes top and bottom portions is provided. The method includes obtaining a container for the sandwich as previously described, thereafter placing the bottom portion of the sandwich into the bottom compartment and placing the top portion of the sandwich into the top compartment, while the container is open. After placing the top portion of the sandwich into the second or top compartment, the grasping tab or end of the insert or platform opposite the support tab is inserted into the elongated slot and the platform is placed over the open portion of the second or top compartment. The support tab is inserted into the locking aperture. Thereafter, the container is closed by folding the top compartment over and onto the bottom compartment. The support tab and the grasping tab or end of the platform in their respective slots or apertures prevent the insert from moving relative to the opening of the second compartment while the container is being closed.

The method in accordance with the invention can be easily accomplished by a human operator and does not require manual support of the platform by the operator to maintain the platform in position relative to the top compartment during closing.

The method can further include assembly of the contents of the two compartments by removing the platform from the container. Removal of the tab and platform can be accomplished while the container is closed by pulling the insert out of the container through the elongated slot.

BRIEF DESCRIPTION OF THE DRAWINGS

FIG. 5 illustrates in perspective view the container of FIG. 1 in an open position after the top and bottom portions of the sandwich have been placed into the respective compartments;

FIG. 6 illustrates in perspective view the container of FIG. 1 containing the top and bottom portions of the sandwich with the insert in position over the top compartment opening;

FIG. 7 illustrates in perspective view the container of FIG. 1 being closed after the sandwich and platform insert have been appropriately placed in the container.

DETAILED DESCRIPTION

Figures 1, 2, 8, 9:
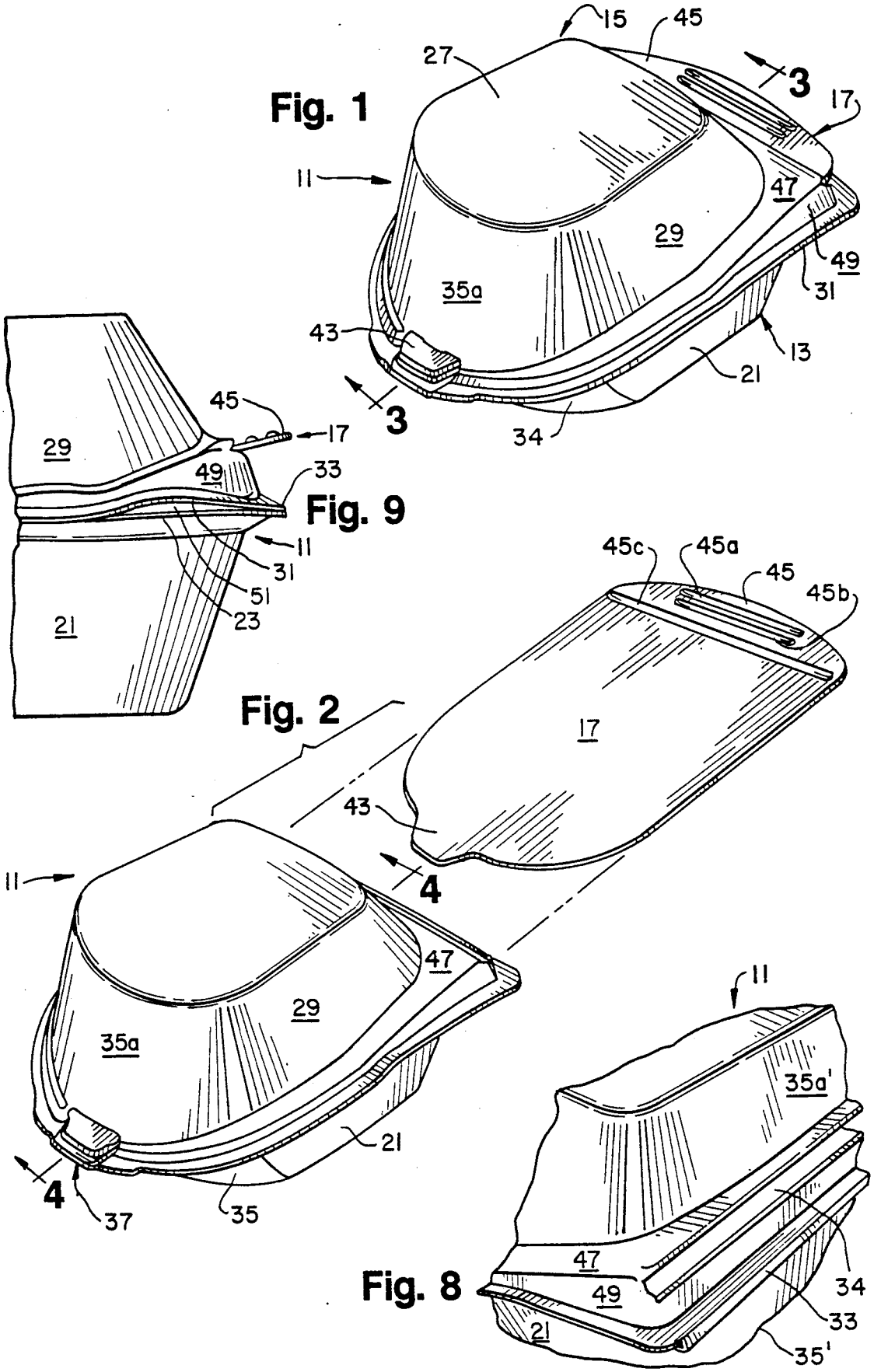
FIG. 1 illustrates in perspective view a container in accordance with the invention in a closed position.
FIG. 2 illustrates in perspective view the container of FIG. 1 showing the insert removed from the container.
FIG. 8 illustrates in perspective view a portion of the container hinge and elongated slot allowing for platform removal.
FIG. 9 illustrates in elevation view a portion of the container of FIG. 1 showing the vent structure.

Referring to the figures generally, and in particular to FIG. 1, there is illustrated in perspective view the sandwich container or package 11. Sandwich container 11 is illustrated in a closed, latched position and is composed of a first or bottom compartment 13, a second or top compartment 15 and an insert 17, which in this case is an insulating platform.

Figure 3:
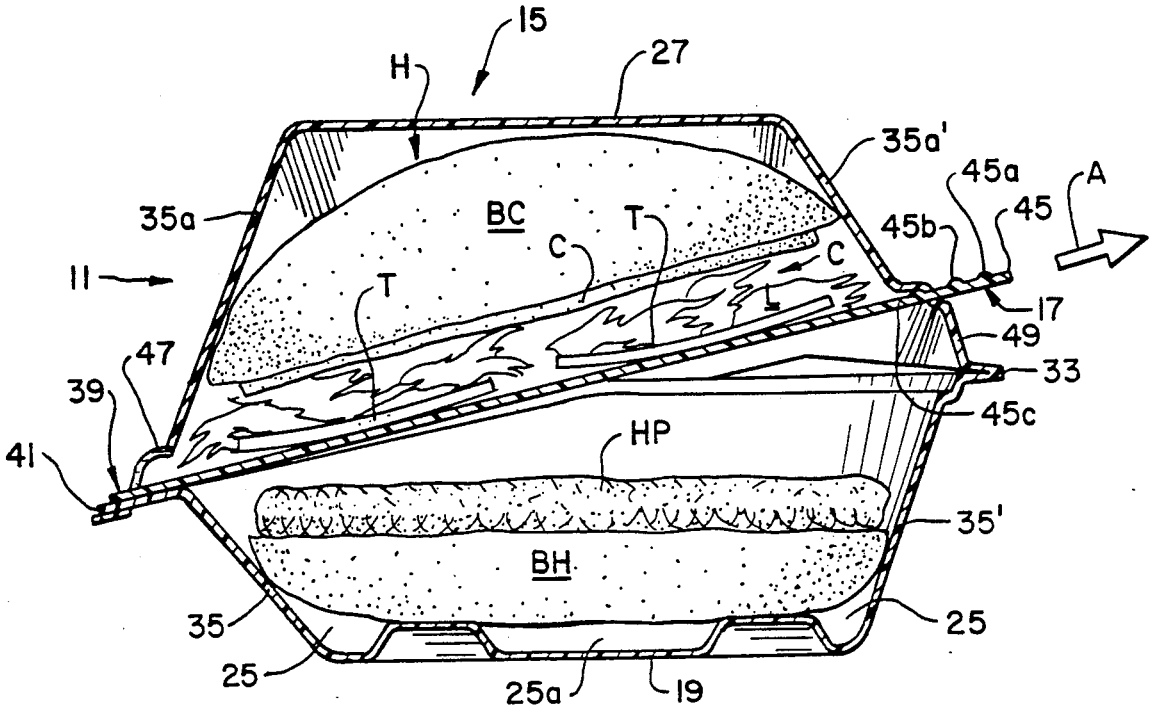
FIG. 3 is a cross-sectional view of the container along lines 3—3 of FIG. 1 showing a hamburger sandwich in the container being separately contained therein.

First or bottom compartment 13 is composed of a bottom portion or wall 19 (shown in FIG. 3) and four side portions, which in this case are upwardly extending side walls 21, front wall 35 and rear wall 35' that terminate with an outwardly extending lip surface 23, as better illustrated in FIG. 5. Side portions 21, as illustrated in FIG. 3, extend slightly outwardly as they extend upwardly.

In the illustrated embodiment, bottom portion 19 includes a trough 25 extending around the periphery of the interior of bottom portion 19. Trough 25 serves to collect any fluids that may drain from the contents and raise bottom portion 19 to facilitate removal of the contents. In addition, a generally rectangular depression 25*a* is provided in the center of bottom wall 19 which helps to keep bun heel BH from becoming soggy. Bottom portion 19 could also be ribbed (not shown) in addition or in place of trough 25 for providing a space between the contents and bottom portion 19 as well as for providing for airflow and fluid collection.

Top compartment 15 includes a top surface 27 and side portions which in this case are downwardly extending side walls 29, front wall 35*a* and a rear wall 35*a'* that terminate at a lip surface 31 that is complementary to lip surface 23 of bottom compartment 13. Top compartment 15 further includes an elongated slot 34 that permits removal of insert 17 therethrough.

Bottom and top compartments 13 and 15 are joined together by a hinge 33 which can be integrally formed in the material of which bottom and top compartments 13 and 15 are formed. Such a hinge is well known in the art, for example, see U.S. Pat. No. 4,132,344, the disclosure of which is hereby incorporated by reference thereto. Hinge 33 is almost as wide as sandwich container 11, which promotes stability of and facilitates closing of container 11.

Front wall portions 35 and 35*a* of bottom and top compartments 13 and 15, respectively, have structure that defines a latch mechanism 37. Latch mechanism 37 includes a locking aperture 39 in top compartment 15 and a locking latch 41 that extends from lip surface 23 of bottom compartment 13. Locking aperture 39 is dimensioned to receive locking latch 41 and a portion of insert 17 as hereinafter described. Such a latch mechanism is well known in the art and thus is not described in detail. For example, such a latch is illustrated in U.S. Pat. No. 4,132,344.

Hinge 33 allows top compartment 15 to be folded over and onto bottom compartment 13 to close sandwich container 11 as illustrated in FIGS. 1 and 7. Hinge 33 also permits the container to be opened by lifting and pivoting top compartment 15 about hinge 33 to an open position, as illustrated in FIG. 5, for example.

Insert 17, which in this case is an insulating platform, forms part of sandwich container 11 and is more completely illustrated in FIG. 2. Insert 17 generally corresponds to the open portion of bottom and top compartments 13 and 15, respectively, as illustrated in FIG. 6. Insert 17 also includes a support tab 43 and a gripping tab 45, which extends the periphery of insert 17 beyond the otherwise generally corresponding shape described above. Gripping tab 45 may be embossed or otherwise labelled with a suitable legend, such as "PULL" (not shown) or can include several ribs 45*a* and 45*b* to facilitate grasping and removing platform 17 from container 11. A third rib 45*c* is provided that extends along substantially the entire width of insert 17 and prevents insert 17 from sliding out of slot 34. Insert 17 can be of any desired shape. A slot or slots complementary to such support tab or tabs could also be provided in appropriate locations of the container side portions to allow insertion and removal of the support tab(s).

Support tab 43 is insertable into locking aperture 39 which is a slot dimensioned to permit insertion of both locking latch 41 and support tab 43, as illustrated in FIGS. 1-3, which restrains movement of insert 17 relative to side portion 29. When so inserted, support tab 43 rests on locking latch 41 of bottom compartment 13.

Gripping tab 45 preferably extends beyond at least one of side portions 29 of container 11 to facilitate removal of insert 17 from container 11 when container 11 is in a closed position, as illustrated in FIGS. 1-3.

Elongated slot 34, which extends along substantially the entire width of side portion 29, as illustrated in FIGS. 6-8, weakens top compartment 15 in the area of slot 34. Top compartment 15 preferably includes a shoulder portion 47 that extends around the periphery of compartment 15 above lip surface 31 and slot 34. Shoulder portion 47 strengthens top compartment 15 particularly in the area adjacent hinge 33 and elongated slot 34. A short wall portion 49 extends between slot 34 and hinge 33 and between shoulder 47 and lip surface 31 to provide further strength and structural integrity to compartment 15.

As illustrated in FIGS. 1-3, elongated slot 34 and locking aperture 39 are positioned so that when insert 17 is in position in container 11 in the closed position (FIG. 3), insert 17 is inclined, preferably at an angle of from about 9-15 degrees and most preferably about twelve degrees from horizontal. A greater or lesser inclination (or no inclination) can be employed. The inclination of insert 17 facilitates removal from container 11 and also improves the assembly of the sandwich contained therein, in this case hamburger sandwich H. As insert 17 is pulled through elongated slot 34 in the direction of arrow A in FIG. 3, the contents in top compartment 15 have a tendency to move in the direction of insert 17 since the contents rest on insert 17. However, movement of the contents of top compartment 15 in the direction of arrow A is restricted because of the limited volume and restricted height of the side of compartment 15 on the side where slot 34 is located. The contents of top compartment 15 would have to be compressed in order to move laterally in the direction of arrow A during removal of insert 17. Because the force exerted by insert 17 upon the contents during removal from container 11 is not very substantial since the contents do not adhere by slide relatively easily with respect to the surface of insert 17, compression of the contents is limited. In addition, when bottom wall 19 is generally horizontal, the inclination of insert 17 allows gravity to exert a force in a direction opposite of arrow A, further facilitating removal of insert 17 and assembly of sandwich H.

In the illustrated embodiment, lip surfaces 23 and 31 of container 11 are at an inclination that generally corresponds to the inclination of insert 17. Thus, as illustrated, the depth of bottom compartment 13 decreases from rear wall 35' to front wall 35 and the depth of top compartment 15 correspondingly increases from rear wall 35*a'* to front wall 35*a*.

FIG. 9 illustrates, in elevation view, a portion of container 11 including a container vent 51. Vent 51 is an opening between bottom compartment 13 and top compartment 15 that results from a gap between lip surface 23 and lip surface 31 when container 11 is closed. Vent 51 readily allows air, water vapor or other gases to escape from bottom compartment 13. This helps prevent the contents, which in this case are relatively hot, stored in bottom compartment 13 from becoming soggy during storage. The side of container 11 opposite the side illustrated in FIG. 9 also has another vent (not shown) similar to vent 51.

FIG. 3 illustrates in sectional view along lines 3—3 of FIG. 1 sandwich container 11 which contains a hamburger sandwich H therein. Hamburger sandwich H is composed of a bun crown BC, condiments C, which in this case include tomato slices T, lettuce pieces L and a slice of cheese CH. Bun crown BC and condiments C are contained within top compartment 15 of sandwich container 11.

A hamburger patty HP and a bun heel BH are contained within bottom compartment 13 as illustrated in FIG. 3.

In the illustrated embodiment, the contents of the bottom compartment are relatively hot and the contents of the top compartment are relatively cool.

As illustrated in FIG. 3, insert 17 serves to separate and insulate bottom compartment 13 and its contents from top compartment 15 and its contents. Moreover, insert 17 carries the weight of the contents of top compartment 15 since the contents, in this case bun crown BC and condiments C rest on insert 17. The weight of the contents of top compartment 15 and the weight of insert 17 is at least partially carried by front and rear walls 35 and 35' of container 11. The support formed by support tab 43 and gripping tab 45 which transmits at least a portion of the weight to the front and rear walls of sandwich container 11 restrain insert 17 from being displaced into bottom compartment 13. This has the effect of preventing or substantially preventing insert 17 from contacting and deforming the contents of bottom compartment 13, which in this case are hamburger patty HP and bun heel BH.

Support tab 43 and gripping tab 45 provide other advantages as hereinafter described.

The container of the invention is easy for the consumer to utilize. When the consumer desires to assemble and consume hamburger sandwich H, insert 17 is removed from container 11 merely by grasping gripping tab 45 and pulling insert 17 through slot 34 in the direction of arrow A without handling by the consumer.

Figure 4:
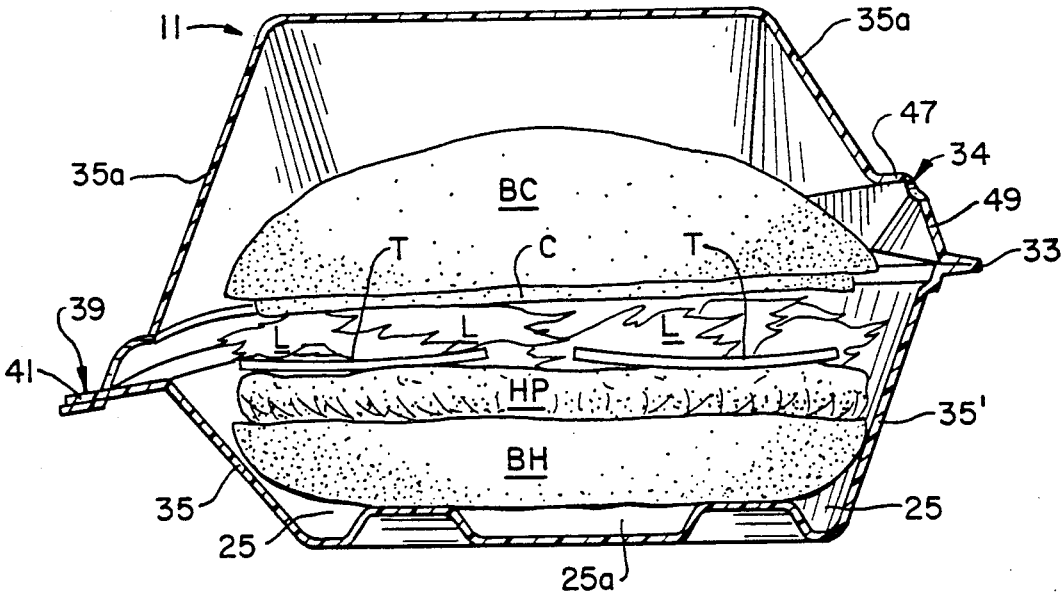
FIG. 4 is a cross-sectional view along lines 4—4 of FIG. 2 wherein the contents of each compartment have been combined after removal of the insert or platform without opening the container.

FIG. 4 illustrates sandwich container 11 with insert 17 removed. The effect of removal of insert 17 is to assemble the sandwich by causing the contents of top compartment 15 to contact the contents of bottom compartment 13. In this case, bun crown BC and condiments C of hamburger sandwich H contact hamburger patty HP. Upon opening sandwich container 11 by releasing latch mechanism 37 and lifting and pivoting top compartment 15, hamburger sandwich H is presented in a configuration ready for removal and consumption (not shown).

The loading and packaging of hamburger sandwich H into sandwich container 11 can be easily accomplished and is illustrated in FIGS. 5–7.

In FIG. 5, sandwich container 11 is in the open position and bun crown BC and condiments C have been placed with the condiments C face up in top compartment 15. Bun heel BH and hamburger patty HP are placed in bottom compartment 13 with hamburger patty HP facing upwardly. After bun crown BC and condiments C are placed in top compartment 15, insert 17 can be placed over top compartment 15, as illustrated in FIG. 6. Insert 17 is placed in position by inserting gripping tab 45 through slot 34, inserting support tab 43 into locking aperture 39 and otherwise placing insert 17 so that it covers or substantially covers the opening of top compartment 15. Placing insert 17 in position can occur either before or after the loading of bun heel BH and hamburger patty HP, as will be readily appreciated.

After hamburger sandwich H has been loaded into container 11, and insert 17 is in place, container 11 is ready for closing. Closing of container 11 is illustrated in FIG. 7 where, for example, a human operator (not shown) closes container 11 by lifting and rotating top compartment 15 about hinge 33 in the direction of arrow B until top compartment 15 is over bottom compartment 13 and sandwich container 11 is closed. Thereafter, latch mechanism 37 can be engaged by inserting locking latch 41 into locking aperture 39. Sandwich container 11 with hamburger sandwich H contained therein is ready for storage or delivery to a customer.

Sandwich container 11 can be constructed of materials as desired. Suitable materials include polystyrene, which may be foamed as well as other foamed material. Foamed material is advantageous because of its insulating properties. Other materials can be of course used as those skilled in the art will recognize. For example, other plastics, paper, cardboard and similar materials can be used.

Compartments 13 and 15 can be fabricated from a single piece of material as disclosed in U.S. Pat. No. 4,132,344.

The specific embodiments shown and described are only illustrative of the present invention. Changes in the structure and method of the present invention would be readily apparent to one skilled in the art. For example, a sandwich container in accordance with the invention can be formed of separate top and bottom compartments that are not connected by a hinge but could be connected by, for example, a pair of latch mechanisms which could be similar to latch mechanism 37, one on either side of the container. The shape of the container in accordance with the invention can of course be as desired, and, for example, the size and shape of each compartment can be the same or similar.

In describing various embodiments herein, the compartments and portions of the container are sometimes referred to as top and bottom. It is to be understood that such relative positions can be reversed or could be otherwise described and the particular orientations utilized herein are for convenience and are not to be construed as a limitation upon the invention.

While the invention has been described with respect to specific embodiments, it is to be understood that the invention is capable of numerous modifications, rearrangements and changes and such modifications, rearrangements and changes are intended to be covered by the scope of the appended claims.

We claim:

1. A container for storing contents in separate compartments comprising:

(a) a first compartment defined by a bottom portion and side portions and having an open portion opposite said bottom portion;

(b) a second compartment defined by a bottom portion and side portions and having an open portion opposite said bottom portion;

(c) hinge means located along and connecting a side portion of each of said first and second compartments permitting said second compartment to be folded over and onto said first compartment to define an enclosed volume comprising said first and second compartments with the bottom portion of said second compartment defining the top of said container when said container is in a closed position;

(d) latch means for locking the package together in said closed position, said latching means including a locking latch extending from the side opposite from the side where said hinge means is located in one of said compartments and a locking aperture in the side opposite from the side where said hinge means is in the other of said compartments, said locking latch and locking aperture located to permit insertion of the locking latch into the locking aperture when the container is in said closed position;

(e) a removable platform positionable over the open portion of said second compartment, said platform having a periphery, a portion of said periphery defining a support tab projecting from said platform, said support tab dimensioned to allow insertion of said tab into said locking aperture when said platform is positioned over said open portion of said second compartment to restrain movement of said platform; and (f) an elongated slot extending adjacent said hinge means in the side of one of said compartments through which said platform can be removed from said container while in said closed position.

2. The container of claim 1 further comprising a gripping tab extending said periphery of said platform opposite from said support tab, said gripping tab extending through said elongated slot and beyond at least one of the side portions of said package when said platform is in position over the opening of the second compartment with said support tab in said locking aperture, for facilitating removal of said platform from said container when said container is in said closed position and for supporting said platform, in conjunction with said support tab.

3. The container of claim 2 wherein said elongated slot extends generally horizontally when said container is in said closed position and said bottom portion of said first compartment is generally horizontal.

4. The container of claim 3 wherein said locking aperture is a slot that extends generally horizontally when said container is in said closed position and said bottom portion of said first compartment is generally horizontal.

5. The container of claim 2 wherein said elongated slot and locking aperture are located so that when said platform is in position with said elongated tab extending through said elongated slot and said support tab is in said locking aperture and said container is in said closed position with the bottom portion of said first compartment being generally horizontal, said platform is inclined upwardly from said locking aperture to said elongated slot.

6. The container of claim 5 wherein said upward incline forms an angle of from about 9 degrees to about 15 degrees from horizontal.

7. The container of claim 6 wherein said angle is about 12 degrees.

8. The container of claim 1 wherein said elongated slot is in said second compartment.

9. The container of claim 1 wherein said latching aperture is in said second compartment.

10. The container of claim 8 wherein said latching aperture is in said second compartment.

11. The container of claim 1 wherein said elongated slot extends along substantially the entire width of the side of one of said compartments.

12. The container of claim 1 wherein each compartment is composed of four side portions including two spaced apart side walls, a front wall and a rear wall.

13. The container of claim 12 wherein the second compartment has a depth that is defined by said four side portions and the depth of the second compartment increases from the rear wall to the front wall.

14. The container of claim 13 wherein the first compartment has a depth that is defined by said four side portions and the depth of the first compartment decreases from the rear wall to the front wall.

15. The container of claim 14 wherein said elongated slot and said locking aperture are located so that when said platform is in position over the open portion of said second compartment with said support tab in said locking aperture and a peripheral portion of said platform is said elongated slot with the container in the closed position with the bottom portion of the first compartment being generally horizontal, the platform is included upwardly from the locking aperture to the elongated slot.

16. The container of claim 15 wherein the platform inclination substantially corresponds to the increase in the depth of the second compartment from the rear wall to the front wall.

17. The container of claim 1 wherein the side of the compartment through which the elongated slot extends includes a strengthened portion adjacent the elongated slot.

18. The container of claim 17 wherein the strengthened portion includes a shoulder extending substantially along the entire length of said elongated slot.

19. The container of claim 18 wherein the shoulder is located above the elongated slot when the container is in the closed position and the second compartment is above the first compartment.

* * * * *

UNITED STATES PATENT AND TRADEMARK OFFICE

CERTIFICATE OF CORRECTION

PATENT NO. : 5,012,971

DATED : May 7, 1991

INVENTOR(S) : Joseph J. Cozzi et al.

It is certified that error appears in the above-identified patent and that said Letters Patent is hereby corrected as shown below:

Col. 5, line 67, delete "by" and insert therefor --but--.

Col. 10, lines 12-13, delete "included" and insert therefor --inclined--.

Signed and Sealed this

Twenty-third Day of March, 1993

*Attest:*

STEPHEN G. KUNIN

*Attesting Officer*

*Acting Commissioner of Patents and Trademarks*